US007645156B2

(12) United States Patent
Titokis

(10) Patent No.: US 7,645,156 B2
(45) Date of Patent: Jan. 12, 2010

(54) ELECTRICAL PLUG-AND-SOCKET CONNECTOR FOR A MOTOR VEHICLE

(75) Inventor: Konstantinos Titokis, Ludenscheid (DE)

(73) Assignee: Kostal Kontakt Systeme GmbH, Ludenscheid (DE)

( * ) Notice: Subject to any disclaimer, the term of this patent is extended or adjusted under 35 U.S.C. 154(b) by 0 days.

(21) Appl. No.: 11/986,100

(22) Filed: Nov. 20, 2007

(65) Prior Publication Data

US 2008/0096406 A1 Apr. 24, 2008

Related U.S. Application Data

(63) Continuation of application No. PCT/EP2006/005710, filed on Jun. 14, 2006.

(30) Foreign Application Priority Data

Jun. 17, 2005 (DE) ..... 10 2005 028 037.4

(51) Int. Cl.
*H01R 13/627* (2006.01)

(52) U.S. Cl. ..... 439/352; 439/489

(58) Field of Classification Search ..... 439/352, 439/357, 358, 488, 489
See application file for complete search history.

(56) References Cited

U.S. PATENT DOCUMENTS

| | | | | |
|---|---|---|---|---|
| 5,624,271 | A * | 4/1997 | Childs et al. | 439/352 |
| 6,196,867 | B1 * | 3/2001 | Kawase et al. | 439/489 |
| 6,341,972 | B1 * | 1/2002 | Odorfer | 439/352 |
| 6,406,319 | B2 * | 6/2002 | Pederson et al. | 439/352 |
| 6,866,534 | B2 | 3/2005 | Hirschmann | |
| 2004/0127087 | A1 | 7/2004 | Hirschmann | |
| 2004/0248453 | A1 * | 12/2004 | McLauchlan et al. | 439/352 |

FOREIGN PATENT DOCUMENTS

| | | | |
|---|---|---|---|
| DE | 297 24 486 | U1 | 8/2001 |
| DE | 100 32 234 | A1 | 1/2002 |
| DE | 101 51 956 | A1 | 7/2002 |
| DE | 102 27 016 | A1 | 1/2004 |
| DE | 202 17 461 | U | 3/2004 |
| WO | WO 97/41623 | | 11/1997 |

* cited by examiner

*Primary Examiner*—Hien Vu
(74) *Attorney, Agent, or Firm*—Brooks Kushman P.C.

(57) ABSTRACT

A connector includes first and second plug-and-socket connector parts and a connection element. The first connector part has a latch operable to connect the connector parts together. The connection element is connected and is displaceable with respect to the first connector part between first and second positions. The connection element has a pair of locking tabs operable with the latch such that the connection element is fixed in the first position until the latch connects the connector parts together and such that the connection element is movable from the first position to the second position when the latch connects the connector parts together. While in the first position the locking tabs release the latch connection such that the connector parts are separable from one another. While in the second position the locking tabs secure the latch connection such that the connector parts are securable connected to one another.

6 Claims, 4 Drawing Sheets a)

b)

ELECTRICAL PLUG-AND-SOCKET CONNECTOR FOR A MOTOR VEHICLE

CROSS-REFERENCE TO RELATED APPLICATIONS

This is a continuation of International Application PCT/EP2006/005710, published in German, with an international filing date of Jun. 14, 2006, which claims priority to DE 10 2005 028 037.4, filed Jun. 17, 2005, the disclosures of which are both hereby incorporated by reference.

BACKGROUND OF THE INVENTION

1. Field of the Invention

The present invention relates to a plug-and-socket connector having first and second plug-and-socket connector parts and a connection element in which a latching element of the first connector part connects the connector parts together after the connector parts have been placed together and the connection element releases the latching element when the connection element is in a first latching position with respect to the first connector part and secures the latching element when the connection element is in a second latching position while the connector parts have been placed together.

2. Background Art

Plug-and-socket connectors connect vehicle electrical components to one another and with the vehicle wiring harness. To secure the assembled parts of a plug-and-socket connector, the parts are connected with one another by latching elements. A lock is used to secure the connection of the latching elements.

DE 297 24 486 U1 (corresponds to U.S. Pat. No. 6,341,972) describes such a plug-and-socket connector. In this connector, a plug part can be latched with a socket part. To accomplish this, the plug part has tongues with latch lugs which engage in receptacles of the socket part. The plug part can have a clip hooked into it which has locking legs running parallel to the tongues. After the plug part and the socket part have been put together, the clip can be latched against the plug part such that it limits the mobility of the tongues engaging into the socket part and thus locks the parts together. The clip can only be released from this latched position by special tools. This connector has the disadvantage that locking the parts by latching the clip after the parts have been put together requires an additional assembly step, and that although the parts are securely connected after being locked, they can only be separated again with substantial effort.

SUMMARY OF THE INVENTION

An object of the present invention includes an electrical plug-and-socket connector whose plug and socket parts (i.e., first and second connector parts) can be connected together easily and securely while being capable of being separated again without great effort.

In carrying out the above object and other objects, the present invention provides an electrical plug-and-socket connector having first and second plug-and-socket connector parts and a connection element. The first connector part has a latching element operable to connect the connector parts together. The connection element is connected to the first connector part and displaceable with respect to the first connector part between first and second latching positions. The connection element has a pair of locking tabs operable with the latching element such that the connection element is fixed in the first latching position until the latching element connects the connector parts together and such that the connection element is movable from the first latching position to the second latching position when the latching element connects the connector parts together. While in the first latching position the locking tabs release the latching element connection such that the connector parts are separable from one another. While in the second latching position the locking tabs secure the latching element connection such that the connector parts are securable connected to one another.

In accordance with embodiments of the present invention, a motor vehicle electrical plug-and-socket connector includes first and second connector parts and a connection element. The connection element is connected with the first connector part in a captive manner and is held by mechanical means to the first connector part in a first latching position with respect to the first connector part such that the connection element cannot be displaced to a second latching position with respect to the first connector part until the connector parts are put together.

The connection element represents an integral portion of the first connector part. One arrangement is for the connection element and the housing of the first connector part to be inside one another so that they cannot be separated from one another. Alternatively, a projection of the connection element can engage into a recess of the first connector part (or vice versa) such that the connection element and the first connector part are connected in a manner in which they are displaceable relative to one another but cannot be separated from one another.

The first connector part and the connection element further have latching means which allow the connection element to assume one of two different latching positions relative to the first connector part.

The connection element further includes locking means. When the connector parts are put together while the connection element is in the first latching position, the locking means release latching elements connecting the first and second connector parts. When the connector parts are put together and connected together by the latching elements while the connection element is in the second latching position, the locking means secure the connection of the latching elements.

When the connector parts are not yet connected together, the connection element is held by the mechanical means in the first latching position such that the connection element cannot be displaced to the second latching position. Only once the connector parts are connected together by the latching elements is it possible for the connection element to move into the second latching position relative to the first connector part which simultaneously causes the locking means to lock together the latching elements connecting the connector parts together.

Advantageously, prior to the connector parts being connected together, the position of the connection element and thus the position of the locking means do not require any special attention as the connection element can only be in the first latching position in which the locking means are in an unlocked position.

The connection element may have a section located outside the housing of the first connector part that is a suitable handling means.

The second latching position of the connection element may be located opposite the first latching position in the plugging direction of the first connector part onto the second connector part. This allows the first connector part to be held on the connection element and plugged onto the second connector part because the connection element is held rigid with respect to the first connector part in its first latching position.

As soon as the connector parts are put together, the mechanical means release the connection element. In turn, the connection element moves into the second latching position that locks the connector parts. This allows the connector parts to be put together and locked in a single operation without interruption. After that, it is possible to separate the connector parts whenever necessary by overcoming the retention force of the latching means between the first and the second latching positions.

For larger plug-and-socket connectors with many pins, it is advantageous to provide several latching means which cause the connector parts to lie tightly against one another. Likewise, it is expedient to provide an appropriate number of locking means to secure the latching means. It is advantageous for these locking means to be connected to one another allowing them to be put on together. It is advantageous for all locking means to be an integral part of the connection element.

The above features, other features, and advantages of the present invention are readily apparent from the following detailed descriptions thereof when taken in connection with the accompanying drawings.

DETAILED DESCRIPTION OF THE PREFERRED EMBODIMENT(S)

Figure 1:
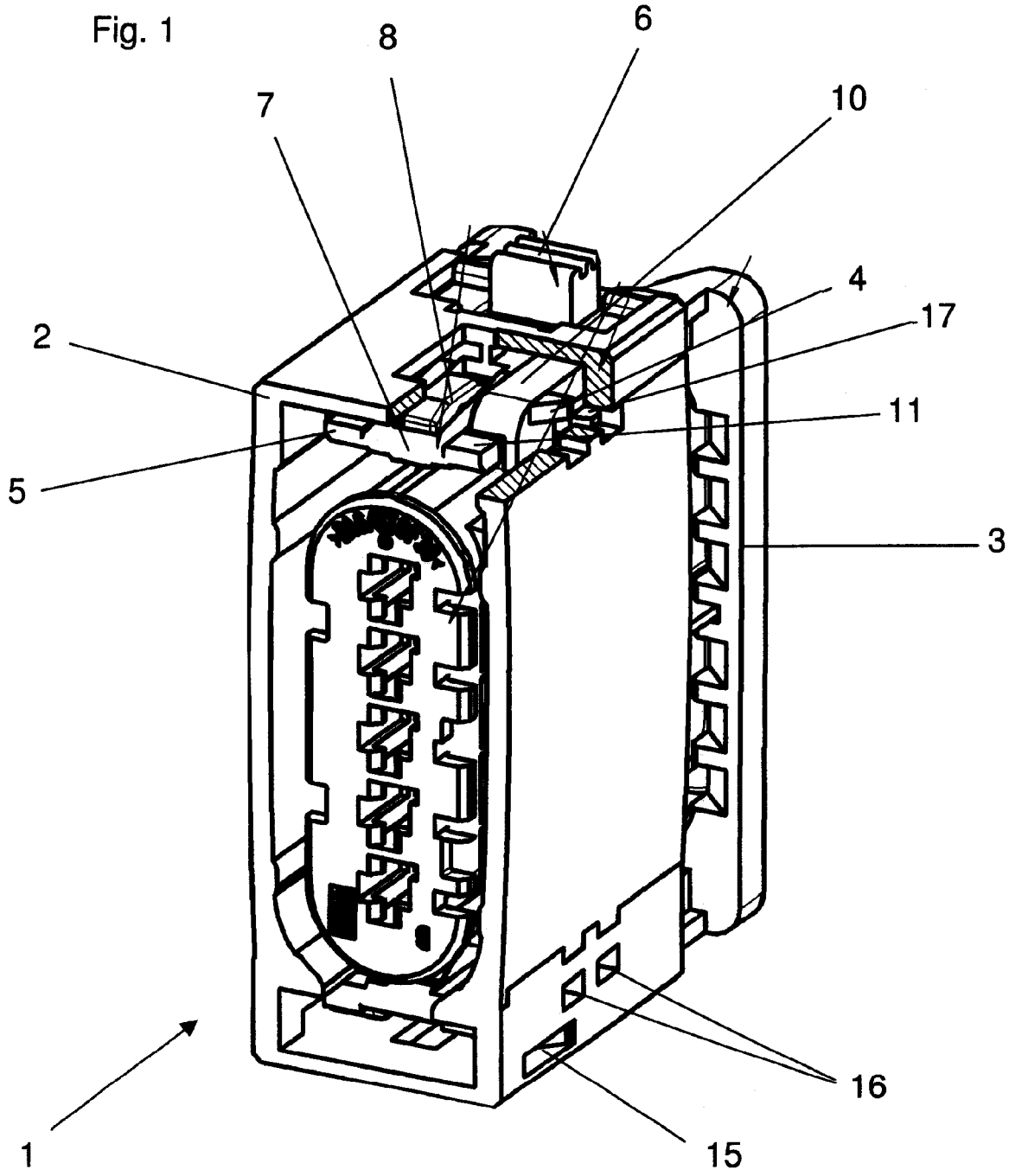
FIG. 1 illustrates the first plug-and-socket connector part of an electrical plug-and-socket connector in accordance with an embodiment of the present invention.

Referring now to FIG. 1, a first plug-and-socket connector part 1 of an electrical plug-and-socket connector in accordance with an embodiment of the present invention is shown. The electrical plug-and-socket connector further includes a second plug-and-socket connector 12 (see FIG. 3). FIG. 1 illustrates an angle view of the plug side of first connector part 1.

First connector part 1 includes two single-piece elements: a receptacle housing 2 and a bolt-like connection element 3. Housing 2 and connection element 3 are connected together such that housing 2 and connection element 3 may be displaced with respect to one another but cannot be separated from one another. To this end, housing 2 and connection element 3 may be formed inside one another.

Alternatively, housing 2 and connection element 3 may be connected together by an inaccessible connection such that housing 2 and connection element 3 may be displaced with respect to one another but cannot be separated from one another. The inaccessible connection is accomplished by barbed latch lugs 4 elastically connected with connection element 3. Each latch lug 4 engages into a respective elongated recess 15 of housing 2 causing connection element 3 to lie against housing 2 such that connection element 3 cannot be separated from housing 2 but may be displaced relative to housing 2. A latch lug 4 and a corresponding recess 15 of housing 2 are located at the top and bottom areas of housing 2.

A latch lug 17 elastically connected with connection element 3 cooperates with a pair of recesses 16 of housing 2 to establish one of two latching positions that connection element 3 can assume with respect to housing 2. A latch lug 17 and a corresponding pair of recesses 16 of housing 2 are located at the top and bottom areas of housing 2.

Housing 2 includes a pair of latching elements 5. Latching elements 5 are integral to housing 2 and are located inside housing 2. Latching elements 5 are in the form of latching arms. Each latching arm 5 can swing against the interior wall of housing 2 in response to actuation by a control element 6. Control element 6 is located on the outside of housing 2. Latching arms 5 are respectively located at the top and bottom areas of housing 2.

Latching arms 5 are used to latch first connector part 1 together with second connector part 12 thereby securing the electrical and mechanical connection of connector parts 1, 12.

Connection element 3 includes two pairs of locking tabs 10. The pairs of locking tabs 10 are respectively located at the top and bottom areas of housing 2. When connection element 3 is displaced from an initial position relative to housing 2, each pair of locking tabs 10 move into the space between a corresponding latching arm 5 and the inner wall of housing 2 thereby blocking the ability of the corresponding latching arm 5 to swivel. As a result, latching arms 5 produce a latching connection to second connector part 12 that can no longer be separated without moving connection element 3 back into the initial position relative to housing 2.

Figure 2:
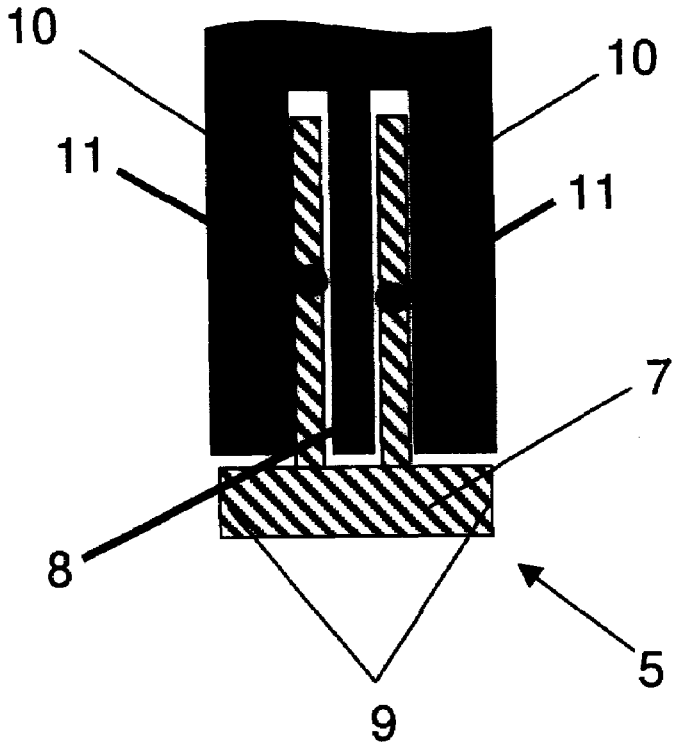
FIG. 2 illustrates an arrangement of locking tabs of the connection element of the first connector part moved into a latching arm of the housing of the first connector part to block the ability of the latching arm to swivel.

Referring now to FIG. 2, with continual reference to FIG. 1, the arrangement of locking tabs 10 moved into latching arm 5 to block the ability of latching arm 5 to swivel is shown. Latching arm 5 includes a pair of parallel latching arm legs 11 joined by a crossbar 7. Crossbar 7 includes two end sections 9 which project beyond the areas that connect with latching arm legs 11. Connection element 3 further includes a pair of springs 8 for each pair of locking tabs 10. Each spring 8 is connected to its associated pair of locking tabs 10. Each latching arm leg 11 is surrounded by a locking tab 10 along an angular outer surface. Spring 8 lies between latching arm legs 11.

Figure 3:
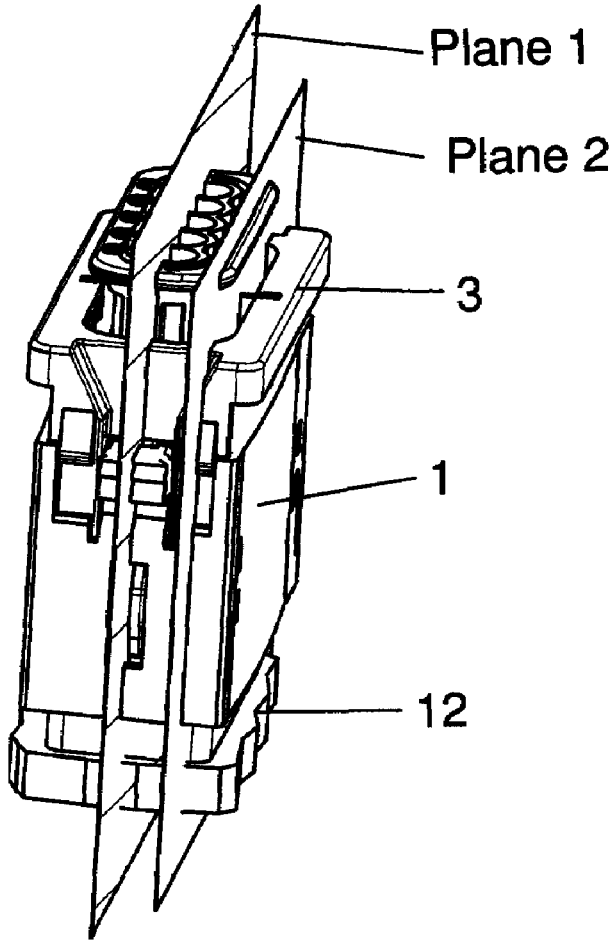
FIG. 3 illustrates a perspective view of the electrical plug-and-socket connector having plugged and connected first and second connector parts.

Referring now to FIG. 3, with continual reference to FIG. 1, a perspective view of an electrical plug-and-socket connector in accordance with the present invention is shown. The plug-and-socket connector includes first connector part 1 with connection element 3 and second connector part 12. As shown in FIG. 3, first and second connector parts 1, 12 are plugged into and connected together.

Figure 4:
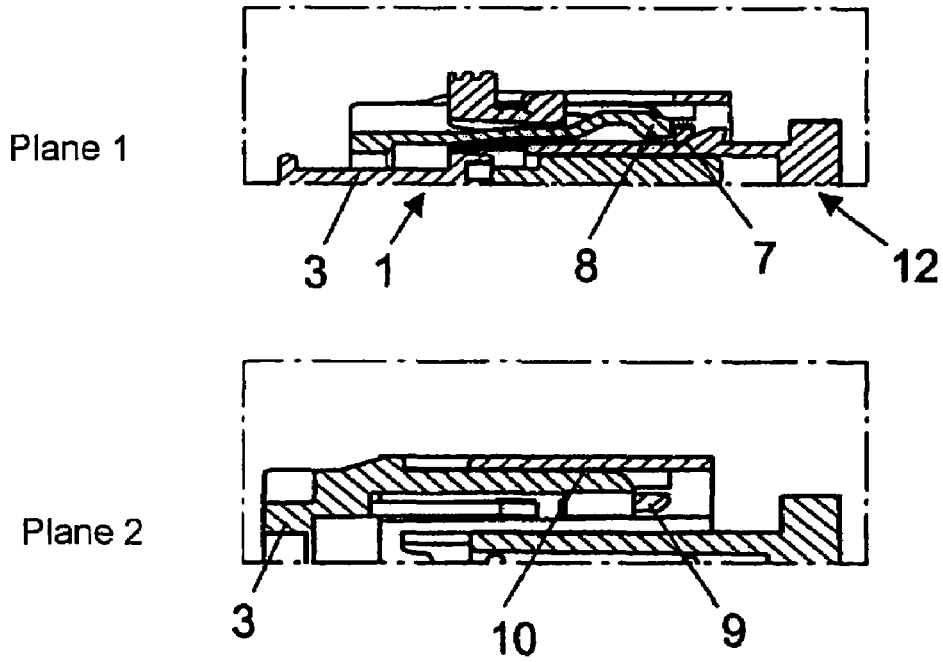
FIG. 4 illustrates a process of plugging and locking together the first and second connector parts of the electrical plug-and-socket connector by a series of sectional drawings for different phases of the assembly.
Figure 4:
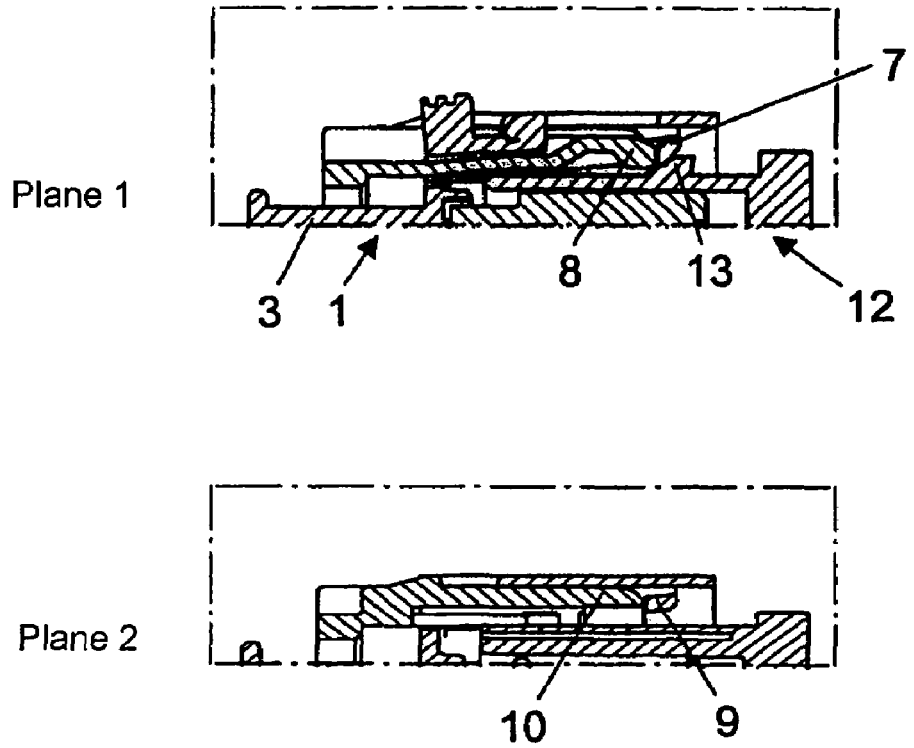
Figure 4:
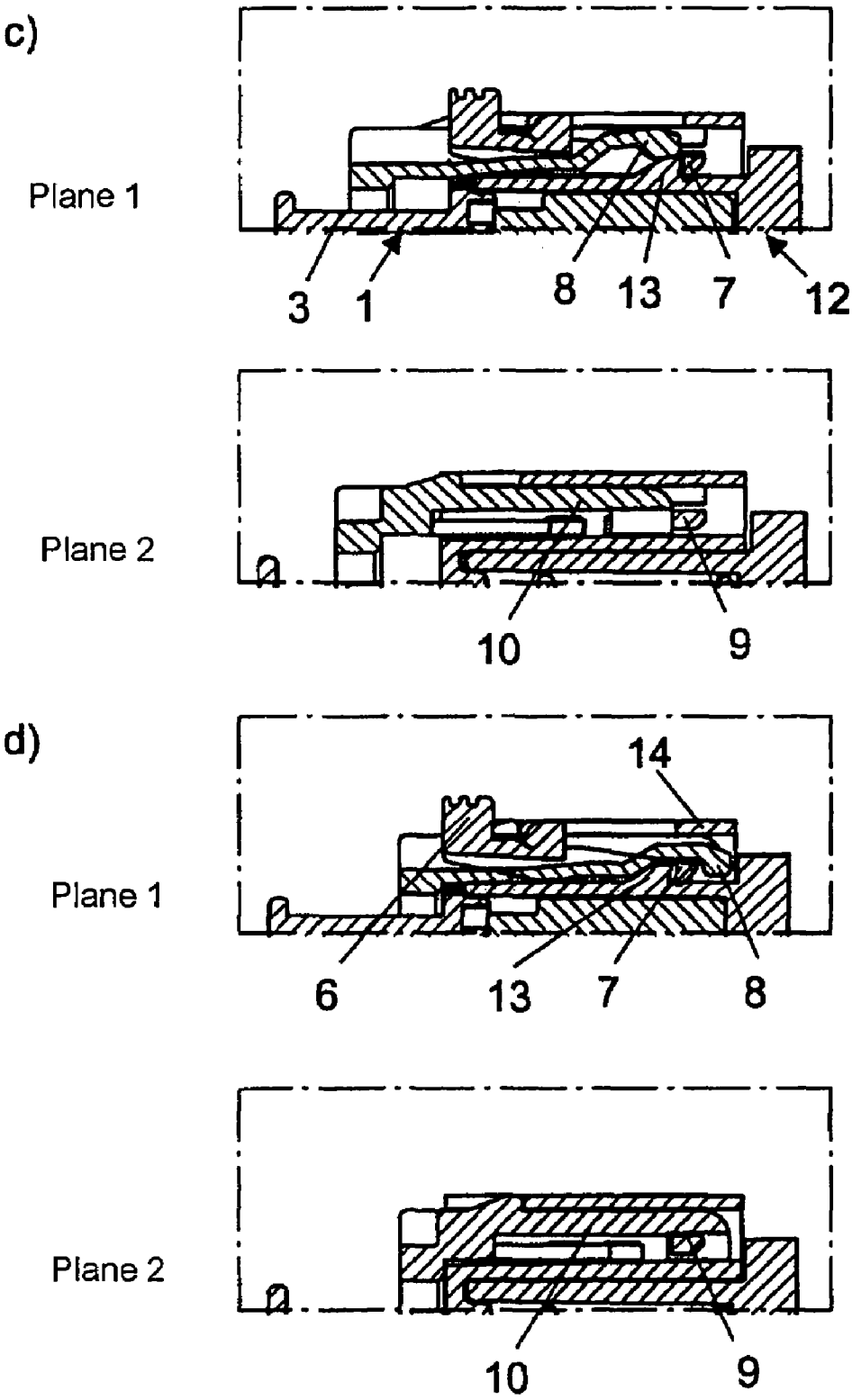

Referring now to FIG. 4, with continual reference to FIGS. 1, 2, and 3, a process of plugging and locking together first and second connector parts 1, 12 is shown by a series of sectional drawings for different phases of the assembly. Each sectional drawing (FIGS. 4*a*, 4*b*, 4*c*, and 4*d*) refers to two different sectional planes (plane 1 and plane 2) through connector parts 1, 12 shown in FIG. 3. In particular plane 1 intersects spring 8 and plane 2 passes through a locking tab 10.

In accordance with embodiments of the present invention, connection element 3 locks latching arms 5 only after first and second connector parts 1, 12 have been put together.

FIG. 4*a* illustrates the beginning of the plugging process in which first and second connector parts 1, 12 have already been pushed a small distance into one another but are not yet latched together. In plane 1, spring 8 lies at the same height and in direct contact with crossbar 7 of latching arm 5. The result is that in this phase of joining, connection element 3 cannot be displaced relative to housing 2. Thus, first connector part 1 appears to an operator as a single compact part which can, for the plugging process, just as well be grasped and guided on the bolt-shaped section of connection element 3. In plane 2, ends of locking tab 10 still lie in front of respective end sections 9 of crossbar 7 of latching arm 5 such that in this plugging phase latching arm 5 is still free to swivel.

FIG. 4*b* illustrates advancement from the beginning of the plugging process. In plane 1, the force acting on connection element 3 causes spring 8 to press on crossbar 7 of latching arm 5 such that crossbar 7 follows a latching contour 13 on second connector part 12. In plane 2, if latching arm 5 is even minimally deflected, then additional overlap between locking tabs 10 and end sections 9 on crossbar 7 of latching arm 5 is produced. This takes the load off spring 8 during the plugging process.

FIG. 4*c* illustrates further advancement of the plugging process with respect to FIG. 4*b*. In plane 1, crossbar 7 of latching arm 5 first goes over latching contour 13 and latches behind latching contour 13. After latching arm 5 latches on second connector part 12, spring 8 is located on the upper labile dead point of latching contour 13. In plane 2, locking tabs 10 and latching arm 5 are simultaneously decoupled as end sections 9 of the released latching arm 5 are now no longer at the same height as locking tabs 10.

As a result, connection element 3 can move with respect to housing 2 and connection element can be put into a position locking connector parts 1, 12. This is shown in FIG. 4*d* which represents further advancement of the plugging process with respect to FIG. 4*c*. In plane 1, the end section of spring 8 has been pushed over crossbar 7 of latching arm 5 and holds crossbar 7 securely behind the edge of latching contour 13. On the side opposite latching arm 5, the mobility of the end section of spring 8 is limited by a housing wall section 14 such that release of the locking by mechanical swiveling of latching arm 5 is prevented by control element 6. In this position, in plane 2, locking tabs 10 overlap end sections 9 of crossbar 7 of latching arm 5 and thus makes a substantial contribution to locking connector parts 1, 12 together.

Unlocking connector parts 1, 12 is only possible by pushing connector element 3 in the direction opposite to the plugging direction of first connector part 1 causing both spring 8 and locking tabs 10 to release the corresponding sections of latching arm 5.

An advantage of the plug-and-socket connector having connector parts 1, 12 which can only be locked once they are put together is that first connector part 1 on connection element 3, which operates the means of locking, can be held and plugged and causes connector parts 1, 12 to be locked together in one operation (i.e., without interruption of the plugging process). This allows quick, economical, and secure assembly of connector parts 1, 12.

LIST OF REFERENCE NUMBERS

1 First plug-and-socket connector part
2 Receptacle housing
3 Connection element (bolt)
4 Latch lug
5 Latch (latching arm)
6 Control element
7 Crossbar
8 Spring
9 Crossbar end sections
10 Locking tabs
11 Latching arm legs
12 Second plug-and-socket connector part
13 Latching contour
14 Housing wall section
15 Elongated recess
16 Recesses
17 Latch lug While embodiments of the present invention have been illustrated and described, it is not intended that these embodiments illustrate and describe all possible forms of the present invention. Rather, the words used in the specification are words of description rather than limitation, and it is understood that various changes may be made without departing from the spirit and scope of the present invention.

What is claimed is:

1. An electrical connector comprising:

first and second connector parts movable to engage with one another along a plugging direction, the first connector part having a latching element including a pair of legs connected to a crossbar in which the legs extend along the plugging direction and the crossbar extends perpendicular to the plugging direction, the second connector part having a latching contour, wherein the crossbar moves along and over the latching contour as the connector parts move toward one another and engages the latching projection in order to latch the connector parts together; and a connection element connected to the first connector part such that the connection element is displaceable with respect to the first connector part between first and second latching positions extending along the plugging direction;

the connection element having an outer portion extended substantially from a top wall to a bottom wall of the first connector part, a pair of locking tabs with a spring positioned in between the locking tabs, the locking;

tabs extending along the plugging direction adjacent respective ones of the legs of the latching element and the spring extending along the plugging direction between the legs of the latching element;

wherein the spring engages the crossbar of the latching element until the crossbar engages the latching contour such that the connection element is fixed in the first latching position, wherein the spring disengages from the crossbar of the latching element when the crossbar engages the latching contour such that the connection element is enabled to be displaced between the first and second latching positions;

wherein the locking tabs engage the crossbar when the crossbar moves along the latching contour such that the locking tabs remove load from the spring when the crossbar moves along the latching contour;

wherein while the connection element is in the second latching position the locking tabs extend over the crossbar to secure the engagement of the crossbar to the latching contour such that the connector parts are securable latched to one another;

wherein the first connector part is a plug connector part and the second connector part is a socket connector part.

2. The connector of claim 1 wherein:

the connection element is connected with the first connector part through a latching connection.

3. The connector of claim 1 wherein:

the connection element and the first connector part are inside one another.

4. The connector of claim 1 wherein:

the latching element is a latching arm that is integral with the first connector part.

5. The connector of claim 4 wherein:

the latching arm is arranged parallel to a housing wall of the first connector part such that the latching arm can swivel with respect to the housing wall.

6. The connector of claim 4 wherein:

the latching arm is arranged inside a housing of the first connector part.

* * * * *